US005285529A

United States Patent [19]

Arena

[11] Patent Number: 5,285,529

[45] Date of Patent: Feb. 15, 1994

[54] PROTECTIVE GLOVE PAD

[76] Inventor: Richard A. Arena, 5107 N. St. Vincent, Tampa, Fla. 33614

[21] Appl. No.: 12,614

[22] Filed: Feb. 2, 1993

Related U.S. Application Data

[63] Continuation of Ser. No. 786,049, Oct. 31, 1991.

[51] Int. Cl.[5] ..... A41D 13/00; A41D 13/08

[52] U.S. Cl. ..... 2/20; 2/16; 2/19; 2/161.1; 2/164

[58] Field of Search ..... 2/16, 19, 20, 161.1, 2/164

[56] References Cited

U.S. PATENT DOCUMENTS

| | | | |
|---|---|---|---|
| 1,465,223 | 8/1923 | Kobbe | 2/19 X |
| 2,798,223 | 7/1957 | Smith | 2/19 |
| 3,890,648 | 6/1975 | Beal | 2/20 |
| 4,617,684 | 10/1986 | Green et al. | 2/19 X |
| 4,630,318 | 12/1986 | Aoki | 2/19 |
| 4,748,690 | 6/1988 | Webster | 2/20 X |
| 4,928,320 | 5/1990 | Aoki | 2/19 |

*Primary Examiner*—Clifford D. Crowder
*Assistant Examiner*—Gloria Hale
*Attorney, Agent, or Firm*—A. W. Fisher, III

[57] ABSTRACT

A protective glove pad for use by a baseball player configured to be positioned between the palm of the player's hand and the interior of a baseball glove to protect the palm of the hand from injury when catching a baseball comprising an enlarged palm pad portion of graduated thickness having an elongated finger pad portion extending outwardly therefrom to selectively position and retain the protective glove pad in the baseball glove.

5 Claims, 2 Drawing Sheets

PROTECTIVE GLOVE PAD

CO-PENDING APPLICATION

This application is a continuation application of pending application Ser. No. 786,049, filed Oct. 31, 1991.

BACKGROUND OF THE INVENTION

1. Field of the Invention

A protective glove pad for use by a baseball player to protect the palm of the hand from injury when catching a baseball.

2. Description of the Prior Art

When playing baseball, the player's hand is struck repeatedly while catching a baseball. As a result, the palm of the hand as well as the joints and bones of the hand are often bruised or otherwise injured despite the use of a conventional baseball glove. Baseball gloves include a pocket with minimum padding to receive the ball in the area of the pocket with flexibility essential for manipulation of the glove during use. Unfortunately the padding in such gloves is ineffective.

To eliminate the sting and reduce bruising players often remove the index finger from the glove through the aperture located across the back of the glove hand. In an effort to overcome the undesirable consequences which attend the use of the glove in this manner and increase the protection of the player's hand without decreasing the player's ability to control the glove, attempts have been made to protect the player's hand with limited success and effectiveness.

For example, protective palm pads have been used. But such pads are usually difficult to maintain in the proper location and reduce hand flexibility within the glove because of the excess padding in the glove pocket.

In addition, batting gloves are ineffective for use as an inner glove inside the baseball glove because such gloves have no padding and are designed solely to increase the batter's grip. All purpose gloves have been designed, but, because of the differences in the optimum design characteristics between a batting glove and a protective glove for catching, such all purpose gloves fail to encompass the optimum design parameters, including proper location, thickness and cushion properties, necessary for proper functioning of a protective glove or glove pad.

U.S. Pat. No. 3,890,648 shows a protective device positioned between the palm of the player's hand and a conventional glove to protect the palm of the hand, knuckle joints and associated carpal and metacarpal bones from injury due to impact forces on the palm during the act of catching.

U.S. Pat. No. 4,617,684 discloses a protective palm pad comprising a pad together with a small and large fastening loop. The small loop encircles the base of the user's forefinger; while, the large loop extends around the back of the user's hand. These two loops hold the player's protective palm pad securely in the desired position on the user's palm.

U.S. Pat. No. 4,987,611 teaches a protective pad for use by a baseball player worn under a catcher's mitt supported on the thumb of the user and extending across the palm to protect the palm from injury.

U.S. Pat. No. 4,748,690 relates to a glove comprising protective shock-absorbing cushions which cover each inner finger and upper palm finger pads. Two optional cushions may be provided to cover the palm from the outer edge of the palm extending inward and upward toward the bottom of the uper palm finger pads cushion and the thumb pad and inner palm below the thumb. The cushions are attached to the glove and are covered by an outer layer of leather.

Additional examples of the prior art are found in U.S. Pat. No. 2,067,791; U.S. Design 243,132 and U.S. Design 243,133.

SUMMARY OF THE INVENTION

The present invention relates to a protective glove pad for use by a baseball player configured to be positioned between the palm of the player's hand and the interior of a baseball glove to protect the palm when catching a baseball.

The protective glove pad comprises an enlarged palm pad portion having an elongated finger pad portion extending outwardly therefrom to selectively position and retain the protective glove pad in the glove as described more fully hereinafter. The enlarged palm pad portion and elongated finger pad portion are cooperatively formed by a first and second outer flexible thin cover member having a flexible layer of impact absorbing material disposed therebetween.

The enlarged palm pad portion is shaped or configured to overlie the palm of the hand including at least a portion of the knuckle joints of the first, second and/or third fingers with the corresponding carpal and metacarpal bones; while, the elongated finger pad portion is shaped or configured to fit any of the fingers of the baseball glove to overlie the palm side of the corresponding finger from at least immediately below the first joint thereof to the region where that finger joins with the palm.

In use, the protective glove pad is placed inside the baseball glove inserting the elongated finger pad portion into one of the fingers of the baseball glove such that the enlarged palm pad portion is aligned or in registry with the pocket of the baseball glove, so positioned, the protective glove pad protects the palm of the hand including at least a portion of the knuckle joints of the first, second and/or third fingers with the corresponding carpal and metacarpal bones; while, the elongated finger pad portion is shaped or configured to fit any of the fingers of the baseball glove to overlie the palm side of the corresponding finger from at least immediately below the first joint thereof to the region where that finger joins with the palm.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

As shown in FIGS. 1 through 5, the present invention relates to a protective glove pad generally indicated as 10 for use by a baseball player configured to be positioned between the palm 12 of the player's hand 14 and the interior of a baseball glove 16 to protect the palm 12 when catching a baseball (not shown).

Figure 1:
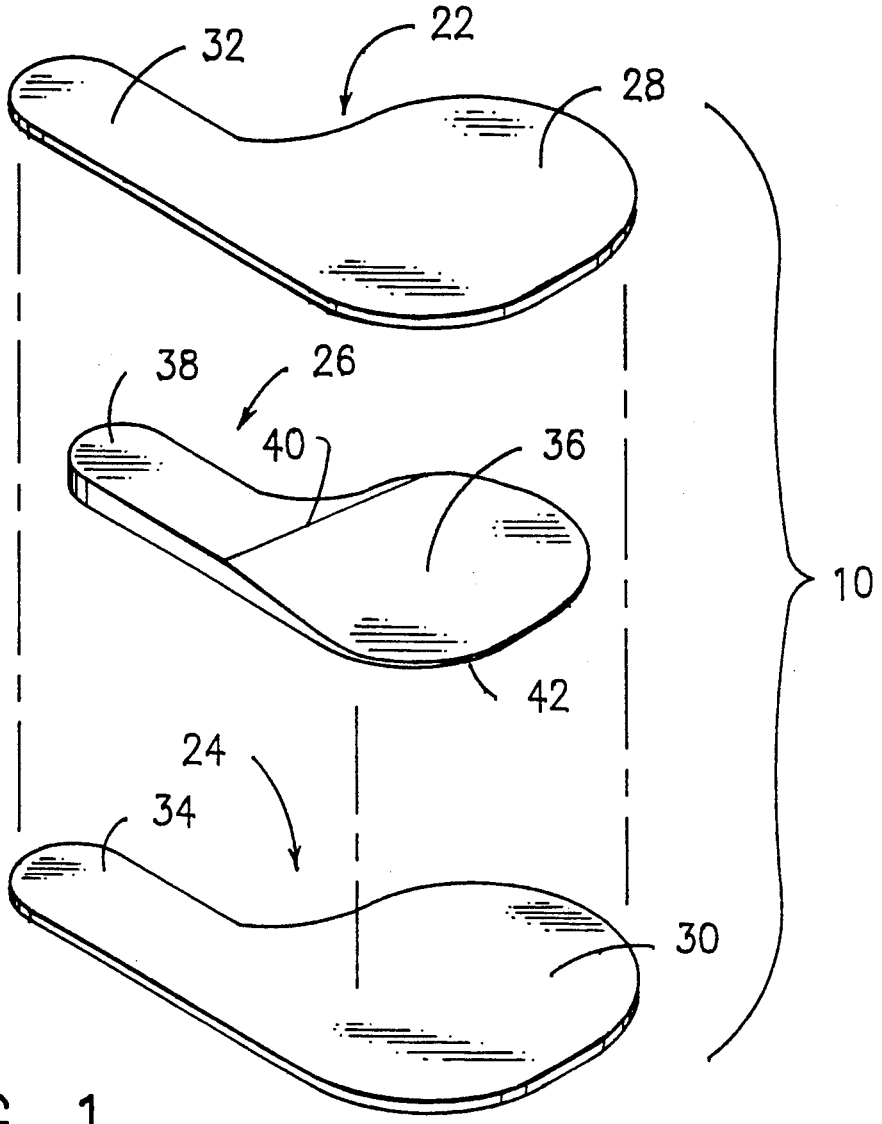
FIG. 1 is an exploded view of the protective glove pad of the present invention.
Figure 2:
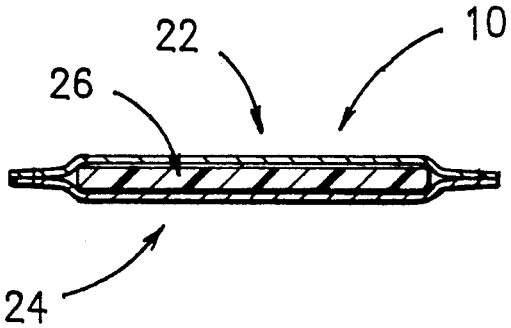
FIG. 2 is a cross-sectional view of the protective glove pad taken along line 2—2 of FIG. 3.
Figure 3:
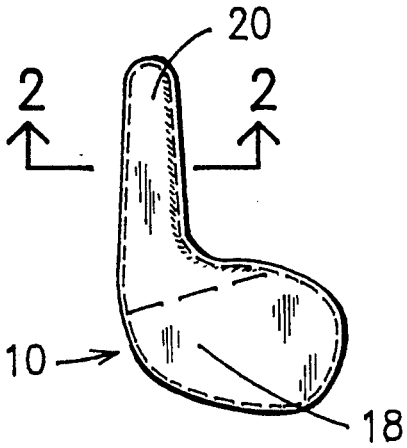
FIG. 3 is a front view of the protective glove pad.

As best shown in FIGS. 1 through 3, the protective glove pad 10 comprises an enlarged palm pad portion 18 having an elongated finger pad portion 20 extending outwardly therefrom to selectively position and retain the protective glove pad 10 in the baseball glove 16 as described more fully hereinafter. The enlarged palm pad portion 18 and elongated finger pad portion 20 are cooperatively formed by a first and second outer malleable, flexible thin cover member generally indicated as 22 and 24 respectively having an inner flexible layer of impact absorbing material generally indicated as 26 disposed therebetween.

As best shown in FIG. 1, the first and second outer malleable, flexible thin cover members 22 and 24 comprise a corresponding enlarged palm pad area indicated as 28 and 30 respectively and a corresponding elongated finger pad area indicated as 32 and 34 respectively. The inner flexible layer of impact absorbing material 26 comprises an enlarged palm pad area 36 and elongated finger pad area 38. As best shown in FIG. 1, the enlarged palm pad area 36 of the inner flexible layer of impact absorbing material 26 has a graduated thickness of approximately one-quarter ($\frac{1}{4}''$) inch at the inner end or edge 40 adjacent the elongated finger pad area 38 to virtually no thickness at the outer end or edge 42 thereof. The first and second outer flexible thin cover members 22 and 24 are preferably constructed of pigskin; while, the inner flexible layer of impact absorbing material 26 is preferably constructed of a layer of foam rubber having a cloth-like backing.

Figure 4:
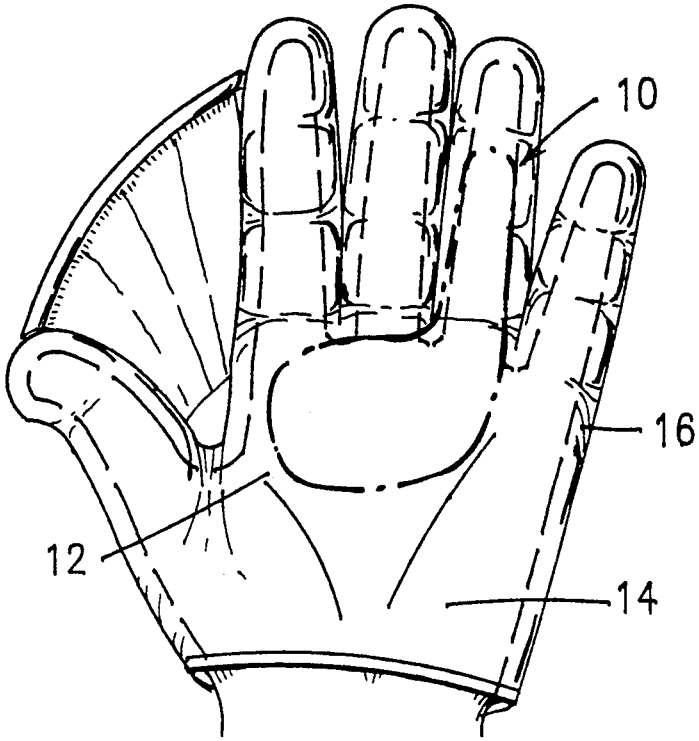
FIG. 4 is a view of the protective glove pad in use with the elongated finger pad disposed adjacent the third finger.
Figure 5:
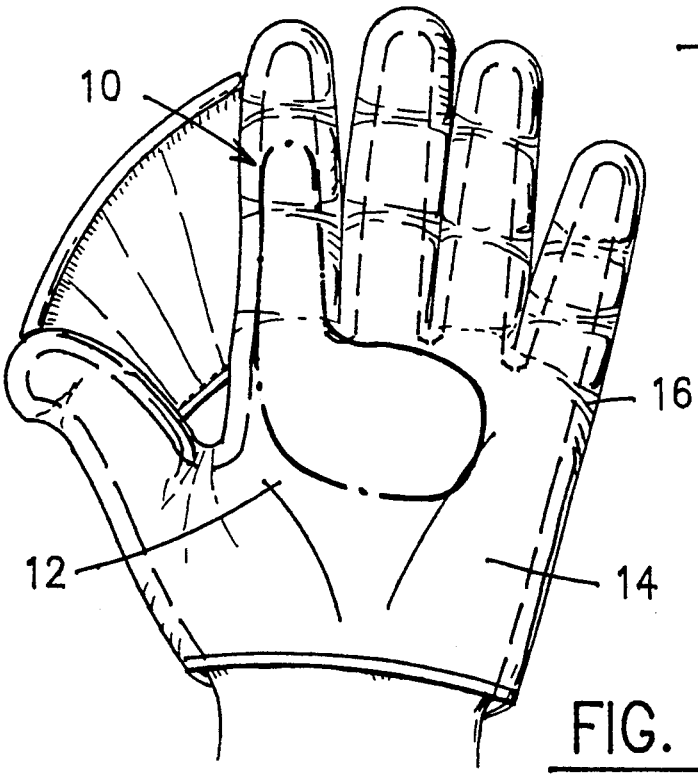
FIG. 5 is a view of the protective glove pad in use with the elongated finger pad disposed adjacent the index finger.

As shown in FIGS. 4 and 5, the enlarged palm pad portion 18 is shaped or configured to overlie the palm 12 of the hand 14 including at least a portion of the knuckle joints of the first, second and/or third fingers with the corresponding carpal bones and corresponding metacarpal bones of the first, second and third fingers. The elongated finger pad portion 20 is shaped or configured to selectively fit any of the fingers of the baseball glove 16 to overlie the palm side of the corresponding finger from at least immediately below the first joint thereof to the region where that finger joins with the palm 12 of the hand 14.

It should be noted that due to the graduated thickness of the enlarged palm pad portion 10 the sweet portion of the pocket is not deleteriously affected. This is particularly important at the second base and shortstop positions. Moreover the elongated finger pad portion 20 retains the protective glove pad 10 in the baseball glove 16 even when the baseball glove 16 is not being used.

In use, the protective glove pad 10 is placed inside the baseball glove 16 inserting the elongated finger pad portion 20 into one of the fingers of the baseball glove 16 such that the enlarged palm pad portion 18 is aligned or in registry with the pocket of the baseball glove 16 so positioned, the protective glove pad 10 protects the palm 12 of the hand 14 including at least a portion of the knuckle joints of the first, second and/or third fingers with the corresponding carpal and metacarpal bones; while, the elongated finger pad portion 20 is shaped or configured to fit any of the fingers of the baseball glove 16 to overlie the palm side of the corresponding finger from at least immediately below the first joint thereof to the region where that finger joins with the palm 12.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A protective glove pad for use by a baseball player configured to be positioned between the palm of the player's hand and the interior of a baseball glove to cover a portion of the palm of the hand to protect at least one knuckle joint and corresponding first joint from injury when catching a baseball comprising an enlarged palm pad portion having an elongated finger pad portion extending outwardly therefrom to selectively position and retain said protective glove pad in the baseball glove, said enlarged palm pad portion and said elongated finger pad portion are cooperatively formed by a first and second outer malleable, flexible thin cover member having an inner flexible layer of impact absorbing material disposed therebetween, said inner flexible layer of impact absorbing material comprises an enlarged palm pad area extending from a lower peripheral edge to an inner terminus edge and an elongated finger pad area extending from said inner terminus edge to a peripheral upper edge corresponding to said corresponding enlarged palm pad portions and corresponding elongated finger pad portion wherein said enlarged palm pad area of the inner flexible layer of impact absorbing material includes an inclined surface substantially uniformly increasing in thickness from said lower peripheral edge to said inner terminus edge and said elongated finger pad area comprises a substantially flat member having a thickness substantially equal to the thickness of said enlarged palm pad area at said inner terminus edge such that the knuckle joint and corresponding first joint are protected by said inner flexible layer of impact absorbing material.

2. The protective glove pad of claim 1 wherein said protective glove pad is placed inside the baseball glove inserting said elongated finger pad portion into one of the fingers of the baseball glove such that said enlarged palm pad portion is aligned or in registry with the pocket of the baseball glove to protect a portion of the palm of the hand, said elongated finger pad portion covers the finger adjacent thereto to protect the first joint of the protected finger and corresponding knuckle joint.

3. The protective glove pad of claim 1 wherein said first and second outer flexible thin cover members are preferably constructed of pigskin.

4. The protective glove pad of claim 3 wherein said inner flexible layer of impact absorbing material is preferably constructed of a layer of foam rubber having a cloth-like backing.

5. A protective glove pad for use by a baseball player configured to be positioned between the palm of the player's hand and the interior of a baseball glove to cover a portion of the palm of the hand to protect at least one knuckle joint and corresponding first joint from injury when catching a baseball comprising an enlarged palm pad portion having an elongated finger pad portion extending outwardly therefrom to selectively position and retain said protective glove pad in the baseball glove, said enlarged palm pad portion and said elongated finger pad portion are cooperatively formed by a first and second outer malleable, flexible thin cover member having an inner flexible layer of impact absorbing material disposed therebetween, said inner flexible layer of impact absorbing material comprises an enlarged palm pad area extending from a lower peripheral edge to an inner terminus edge and an elongated finger pad area comprising substantially flat member having a thickness substantially equal to the thickness of said enlarged palm pad area at said inner terminus edge extending from said inner terminus edge to a peripheral upper edge corresponding to said corresponding enlarged palm pad portions and corresponding elongated finger pad portion wherein said enlarged palm pad area of the inner flexible layer of impact absorbing material includes an inclined surface substantially uniformly increasing in thickness from said lower peripheral edge to said inner terminus edge, said protective glove pad being placed inside the baseball glove and inserting said elongated finger pad portion into one of the fingers of the baseball glove such that said enlarged palm pad portion is aligned or in registry with the pocket of the baseball glove to protect a portion of the palm of the hand, said elongated finger pad portion covers the finger adjacent thereto such that the first joint of the protected finger and corresponding knuckle joint are protected by said inner flexible layer of impact absorbing material.

* * * * *